United States Patent [19]

Hirai et al.

[11] Patent Number: 4,521,183

[45] Date of Patent: Jun. 4, 1985

[54] COOKING APPLIANCE

[75] Inventors: Masayoshi Hirai, Nara; Junzo Tanaka, Fujiidera; Katsuroh Ueda, Yamatokoriyama, all of Japan

[73] Assignee: Matsushita Electric Industrial Co., Ltd., Kadoma, Japan

[21] Appl. No.: 516,604

[22] PCT Filed: Nov. 11, 1982

[86] PCT No.: PCT/JP82/00439

§ 371 Date: Jul. 7, 1983

§ 102(e) Date: Jul. 7, 1983

[87] PCT Pub. No.: WO83/01828

PCT Pub. Date: May 26, 1983

[30] Foreign Application Priority Data

Nov. 12, 1981 [JP] Japan ..... 56-182060

[51] Int. Cl.[3] ..... F27B 9/40; F23M 1/00

[52] U.S. Cl. ..... 432/37; 236/15 BG

[58] Field of Search ..... 236/15 BG; 432/37, 51; 364/477

[56] References Cited

U.S. PATENT DOCUMENTS 4,425,930 1/1984 Kruto ..... 432/51

4,430,719 2/1984 Pearson ..... 432/37

FOREIGN PATENT DOCUMENTS 54-139195 9/1979 Japan .

56-113942 9/1981 Japan .

2011677 7/1979 United Kingdom ..... 364/477

*Primary Examiner*—John J. Camby

*Attorney, Agent, or Firm*—Wenderoth, Lind & Ponack

[57] ABSTRACT

A cooking appliance using a gas fuel as a heat source and having an appliance body includes comprising a temperature sensor installed in a heating chamber, a control circuit adapted to be actuated by the output from the temperature sensor and to operate according to three working temperatures, namely, a preset temperature, an upper limit temperature and a lower limit temperature, the arrangement being such that when the temperature in the heating chamber being detected by the temperature sensor reaches the upper limit temperature, the main burners are completely closed; when it reaches the preset temperature, the firing of the main burners is reduced by half; and when it reaches the lower limit temperature, the main burners are fully opened, thereby effecting fine temperature control, the firing rate being automatically adjusted according to variations in external conditions affecting the heating chamber temperature, thereby maintaining the preset temperature throughout the heating operation to provide a satisfactory cooking result.

2 Claims, 14 Drawing Figures

COOKING APPLIANCE

BACKGROUND OF THE INVENTION

1. Field of the Invention

The present invention relates to a composite cooking appliance consisting of a gas oven and a microwave oven, or a cooking appliance such as a gas oven, and it particularly relates to a temperature control device therefor utilizing gas combustion.

2. Description of the Prior Art

The remarkable advance of semiconductor technology has resulted in sophistication of control circuits, miniaturization of such circuits by higher integration, and reduction of the costs of such circuits by mass-production, and these electronic control circuits have come to be also widely used in household electric equipment.

The technique using intelligence based on this electronic control is making rapid inroads into various heating apparatuses including electric ovens, microwave ovens, gas ovens, and combinations thereof.

One of the most important factors in cooking appliances based on gas combustion is exact temperature control. Since the quality of cooking depends on temperature, it is important that a preset temperature suitable for a given heating load be maintained accurately. Conventional cooking appliances using gas have temperature control means, most of which have been liquid expansion control methods and bimetals.

A gas oven will be taken up by way of example. There is an arrangement wherein a main burner is fired to produce hot air, which is fed into the heating chamber of the oven to cook a heating load therein. The operation of a gas oven of this arrangement will be described with reference to FIGS. 4 and 5. When the user sets the knob at a certain temperature, two temperatures, upper and lower limit temperatures $T_1$ and $T_2$, are set by a control circuit. When cooking is started, the main burners start firing and eventually the upper limit temperature $T_1$ will be reached at time $t_2$. Then, the main burners stop firing, so that the temperature in the oven heating chamber gradually lowers until the lower limit temperature $T_2$ is reached at time $t_3$. Then, the main burners start firing again, repeating this cycle henceforth. If the preset temperature is changed to a higher one after passage of time $t_7$ (the upper and lower limit temperatures being $T_3$ and $T_4$, respectively), the upper limit temperature $T_3$ is reached at time $t_8$, as shown in FIG. 4, and henceforth the same operation as described above is repeated.

Thus, the conventional gas oven is designed to control temperature by the on-off operation of the main burners to maintain the oven heating chamber temperature at a preset value, but this design has the following drawbacks.

The pressure of household gas differs with districts. Even in the same district, the gas pressure available for the gas oven installed in a home will always very owing to the turning on and off of gas in other homes or in another room in the same home. Thus, if the gas pressure drops below the normal value, this decreases the rate of heat generation by the main burners, thus requiring a longer time than usual to reach the preset temperature and hence a longer cooking time.

Further, since the ambient temperature of the air surrounding the gas stove differs greatly between midsummer and midwinter, the cooking time will be different in midsummer, particularly in a drafty room.

Furthermore, because of the design to which turns off all of the main burners upon reaching of the upper limit temperature and turns on all of the main burners upon reaching of the lower limit temperature, the actual difference in temperature between the two extremes is as great as about 10° C., showing that this design fails to attain the purpose of maintaining a temperature at a constant value. Furthermore, the need for frequently turning on and off the main burners entails the drawback of shortening the life of the control circuit system, particularly the relay.

SUMMARY OF THE INVENTION

The present invention eliminates such conventional drawbacks.

Accordingly, an object of the invention is to provide a heating appliance having an automatic control function, wherein a control circuit automatically compensates for external conditions which affect the gas oven heating chamber temperature. More particularly, it provides a cooking appliance comprising a heating chamber for receiving a heating load, a heating means for heating said heating chamber, a temperature sensor for detecting the temperature in said heating chamber, and a control means including a microcomputer for controlling the output and heating time of said heating means in response to signals from said temperature sensor, wherein temperatures detectible by said temperature sensor are classified into at least three levels, namely, upper limit, middle and lower limit temperatures according to a preset heating temperature and the output of said heating means is changed stepwise according to the temperatures at the respective levels so as to control the heating chamber with respect to said preset heating temperature. It is so designed that if the capacity of a main burner in operation is insufficient for a preset temperature, another main burner is fired so as to maintain the preset temperature as constant as possible, and when the preset temperature is attained, a minimum number of main burners are operated intermittently or in an on-off manner to maintain the temperature at the preset value.

DESCRIPTION OF THE PREFERRED EMBODIMENT

Figure 1:
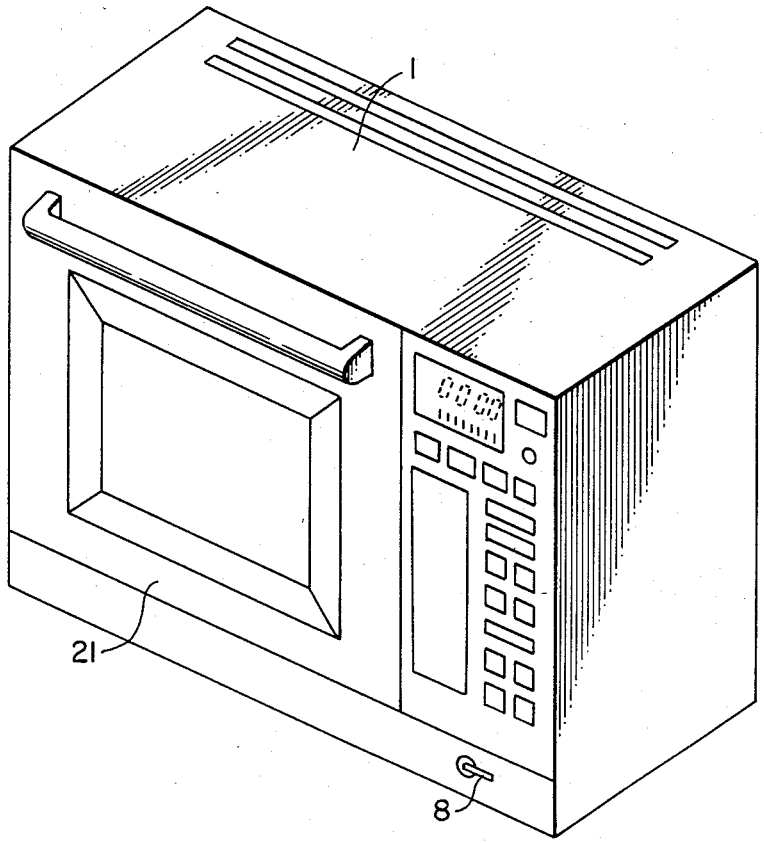
FIG. 1 is a perspective view of a cooking appliance according to an embodiment of the present invention.

An embodiment of the invention will now be described. A cooking appliance body 1 shown in FIG. 1 represents a composite cooking appliance comprising a combination of a microwave oven and a gas oven, but only the gas oven section will be taken up for explanation.

Figure 2:
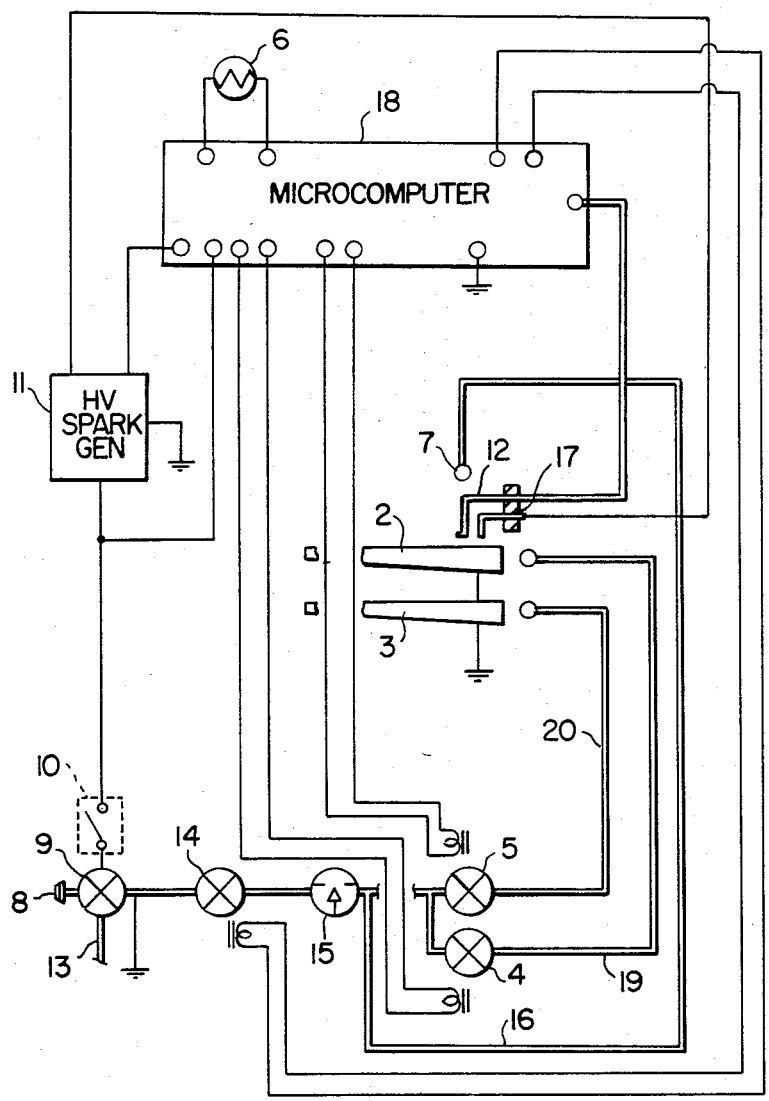
FIG. 2 is a layout view of said cooking appliance.
Figure 4:
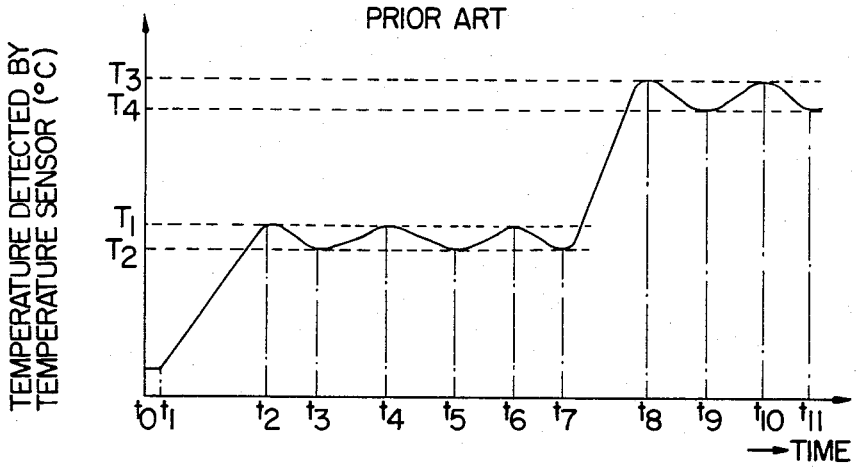
FIG. 4. PRIOR ART
FIGS. 4 and 5 are a detection temperature characteristic diagram and a combustion heat generation rate characteristic diagram of a conventional cooking appliance.
Figure 5:
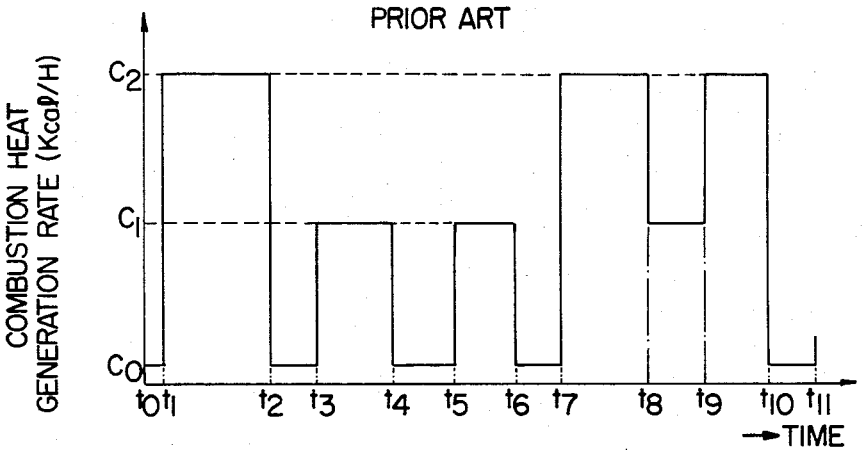
FIG. 5. PRIOR ART

In FIG. 2, turning a gas cock knob 8 opens a gas cock 9 and simultaneously turns on a gas cock switch 10, actuating a high voltage spark generator 11 to cause an ignition plug 12 to produce a spark. On the other hand, the gas entering through a hose end 13 passes successively through the gas cock 9, a now-opened main solenoid valve 14, a governor 15 and a pilot gas passage 16, and enters a pilot burner 7. The latter is ignited by said spark and a thermocouple 17 is thereby heated, signaling a microcomputer 18 to open first and second solenoid valves 4 and 5. The gas flows through main gas passages 19 and 20 into main burners 2 and 3, where it is ignited by said pilot burner 7. Henceforth a temperature sensor 6 detects the temperature in the heating chamber (not shown), signaling the microcomputer 18 to turn the first and second solenoid valves 4 and 5 on and off so as to control the oven heating chamber temperature to maintain it at a preset heating temperature.

Figure 3:
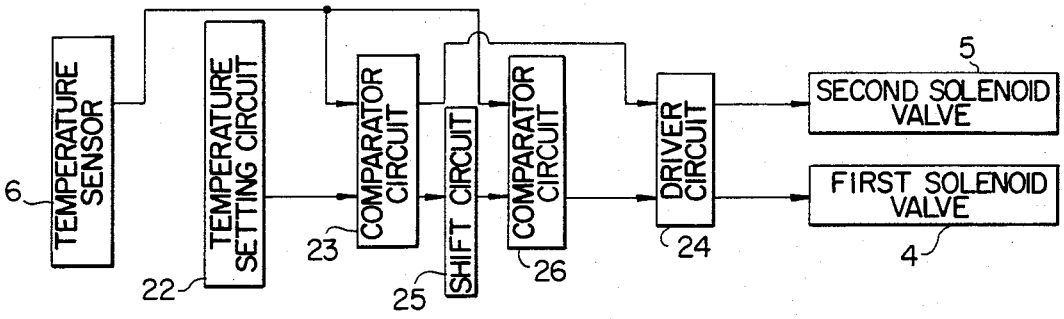
FIG. 3 is a block diagram for explaining the operation of a microcomputer incorporated in said heating appliance.

The configuration of the microcomputer 18 or of FIG. 2 is shown in FIG. 3. The output from the temperature sensor 6 and the output from a temperature setting circuit 22 which has been preset by the user are compared in a comparator circuit 23. If the temperature detected by the temperature sensor 6 is higher than the preset temperature, the comparator circuit 23 actuates a driver circuit 24 to cut off the second solenoid valve 5. As a result, one main burner 3 stops firing.

If the temperature further rises by about 3° C., a shift circuit 25 is actuated to cause a comparator circuit 26 to make a comparison between the output from the temperature sensor 6 and the output from the temperature setting circuit 22. If the temperature detected by the temperature sensor 6 is higher, the comparator circuit 26 actuates the driver circuit 24 to cut off the first solenoid valve 4. As a result, the other main burner 2 stops firing.

Cooking in the High Temperature Region

Figure 6:
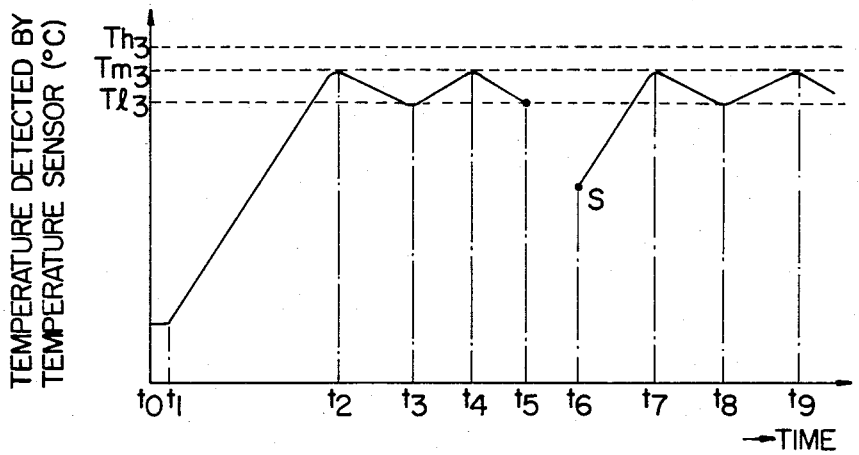
FIGS. 6, 7 and 8 are a detection temperature characteristic diagram, a combustion heat generation rate characteristic diagram, and a heating chamber temperature characteristic diagram in the "strong" state of a cooking appliance according to an embodiment of the invention.
Figure 7:
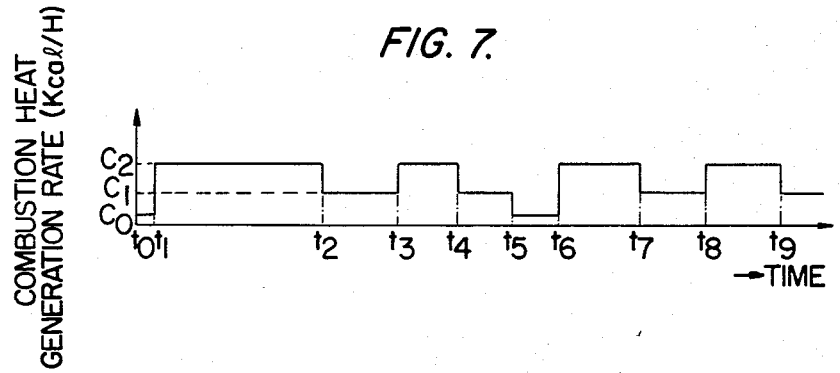
Figure 8:
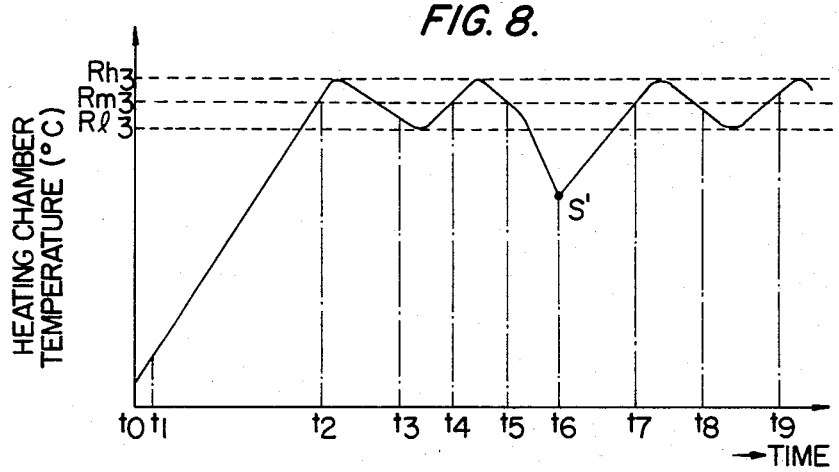

FIGS. 6–8 illustrate a situation where the heating chamber temperature is set in the 250°–300° C. range which is a high cooking temperature region for cooking loads including fish and sweet potatoes which require 300° C. In the case where the preset temperature is 300° C., different valves of heating chamber temperature are indicated by $Rm_3$, ($Rm_3$+about 3° C.) by $Rh_3$, and ($Rm_3$−about 3° C.) by $Rl_3$. Similarly, temperatures detected by the temperature sensor 6 in the case of said preset temperature of 300° C. are indicated by the middle temperature $Tm_3$, upper limit temperature $Th_3$ and lower limit temperature $Tl_3$. The preset temperature is established by the user adjusting the knob to 300° C.; thus, three temperatures are designated, two of which are shifted 3° C. above and below said temperature of 300° C. In order to detect heating chamber temperatures more accurately it is so arranged that the temperature sensor 6 will detect them at points about 5° C. higher. This is because there is a discrepancy between the heating chamber temperature and the temperature detected by the sensor 6. That is:

Middle temperature $Tm_3 = Rm_3$+about 5° C.

The same is true of the upper limit temperature $Th_3$ and the lower limit temperature $Tl_3$. Detection of temperatures by the temperature sensor provides on-off control of the main burners 2 and 3, whereby the heating chamber temperature is adjusted. Where the pilot burner 7 is firing at all times, let the combustion heat generation rate be indicated by $C_2$ Kcal/h when the two main burners 2 and 3 are all fired, by $C_1$ Kcal/h when the main burner 2 alone is fired, and by $C_0$ Kcal/h for the pilot burner 7 alone.

In the initial stage of combustion, the main burners 2 and 3 are fired, rapidly heating the heating chamber with the combustion heat generation rate of $C_2$. Upon lapse of $t_1$ minutes, when the temperature being detected by the temperature sensor 6 reaches the middle temperature $Tm_3$° C., the microcomputer 18 turns off the second solenoid valve 5, putting out the main burner 3. At this time, the main burner 2 remains firing. Thus, the combustion heat generation rate lowers to $C_1$ Kcal/h. However, the heating chamber temperature drops after it has overshot or some time owing to the remaining heat. When the temperature being detected by the temperature sensor 6 reaches the lower limit temperature $Tl_3$, the microcomputer 18 turns on the second solenoid valve 5, igniting the main burner 3. Thereafter the aforesaid control is repeated until completion of cooking.

Thus, when the temperature being detected by the temperature sensor 6 reaches the middle temperature $Tm_3$° C., one of the two burners, or the burner 3, is automatically put out, and it depends on the value of the preset temperature whether the heating chamber temperature further rises, remains as it is, or drops. More particularly, in the case of cooking in the high temperature region around 300° C., stopping one burner 3 results in the heating chamber temperature tending to lower at a rate dependent on the heating chamber heat capacity and burner capacity, until it reaches the lower limit temperature $Tl_3$. Thereupon, the control circuit is actuated again to ignite the previously stopped main burner 3. Since the other main burner 2 remains firing during this period of time, the temperature in the heating chamber is kept high, thus eliminating the drawback of the conventional control means causing a large difference in temperature owing to the fact that all the burners simultaneously turn on and off repeatedly. Theoretically, the size of temperature change is half that for the conventional control means.

It is so arranged that if the door 21 should be opened in the course of cooking, as at $t_5$, the flames of the main burners 2 and 3 will be put out for safety and the hot air circulation fan (not shown) will be stopped; but this will rapidly lower the temperature in the heating chamber. The door 21 is closed and heating is restarted, when the temperature in the heating chamber is S'° C., which is below the lower limit temperature $Rl_3$, while the temperatures S° C. detected by the temperature sensor 6 at this time is also below the lower limit temperature $Tl_3$. As a result, the main burners 2 and 3 are ignited. The hot air circulation fan is also operated again. The normal control will be repeated henceforth.

In FIG. 6, if the temperature sensor 6 detects the upper limit temperature $Th_3$ for some reason or other (which detection is not illustrated), the main burners 2 and 3 are put out, with the pilot burner 7 alone firing.

As described above, in the "high" range between 250° C. and 300° C., three detection levels are assigned to the temperature sensor 6 to detect the lower limit, middle, and upper limit temperatures. The two main burners 2 and 3 are used in the initial stage of heating and when the middle temperature $Tm_3$ is reached, the main burner 3 is put out, with only one being used for heating. When the lower limit temperature $Tl_3$ is reached, both burners take part in heating, but when the upper limit temperature $Th_3$ is reached, both of the main burners 2 and 3 are put out, with the pilot burner 7 alone firing. The aforesaid detection levels of the temperature sensor 6 are stored in the microcomputer 18 in advance, and when the preset temperature value is inputted into the microcomputer, the optimum upper limit, middle and lower limit temperatures are selected and control is effected.

Cooking in the Middle Temperature Region

Figure 9:
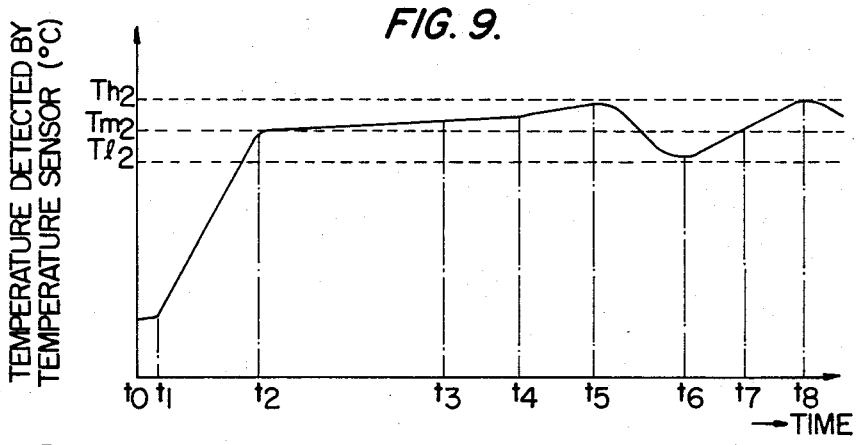
FIGS. 9, 10 and 11 are a detection temperature characteristic diagram, a combustion heat generation rate characteristic diagram and a heating chamber temperature characteristic diagram in the "medium" state of said appliance.
Figure 10:
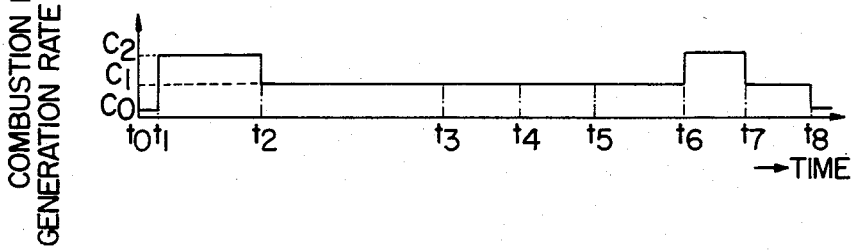
Figure 11:
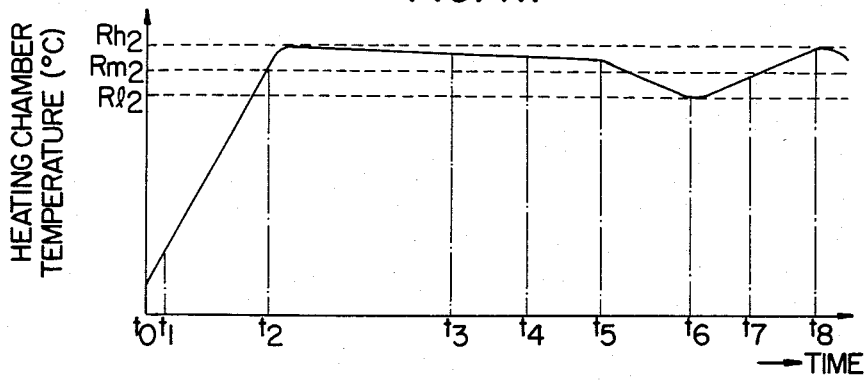

A description will be given of a manner of control which is effected where the preset heating temperature is in the "middle" range of about 200°-250° C. As shown in FIGS. 9-11, the two main burners 2 and 3 are used in the initial stage of heating, and when the temperature being detected by the temperature sensor 6 reaches the middle temperature $Tm_2$, one main burner 3 is put out. Upon lapse of $t_6$ minutes during which overshooting takes place, the lower limit temperature $tl_2$ is reached, whereupon the main burner 3 is ignited. The control continues with this operation repeated, but when the upper limit temperature $Th_2$ is reached, both main burners are put out.

Thus, in the case where the preset temperature is in the middle region, the temperature in the heating chamber will not change so much even if one main burner 3 is put out, thus allowing the other main burner 2 alone to continue firing. If such a combustion state proceeds until the upper limit temperature $Th_2$ or lower limit temperature $Tl_2$ is reached, the control circuit performs the same control operation as described above to maintain the preset temperature.

Cooking in the Low Temperature Region

Figure 12:
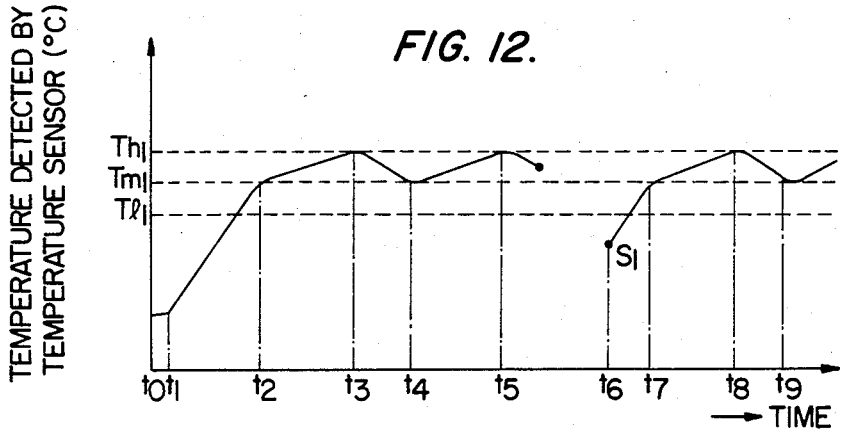
FIGS. 12, 13 and 14 are a detection temperature characteristic diagram, a combustion heat generation rate characteristic diagram and a heating chamber temperature characteristic diagram in the "weak" state of said appliance.
Figure 13:
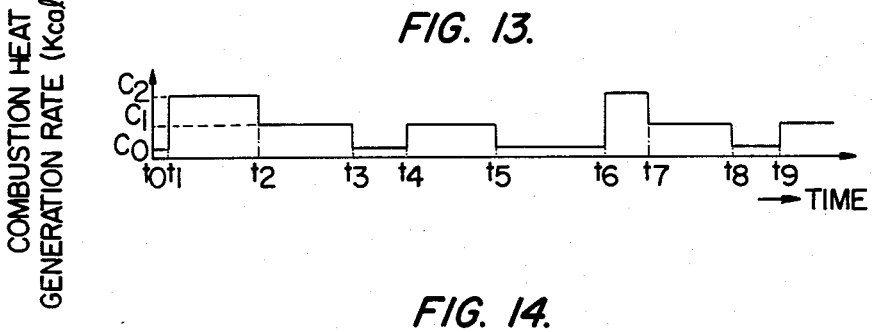
Figure 14:
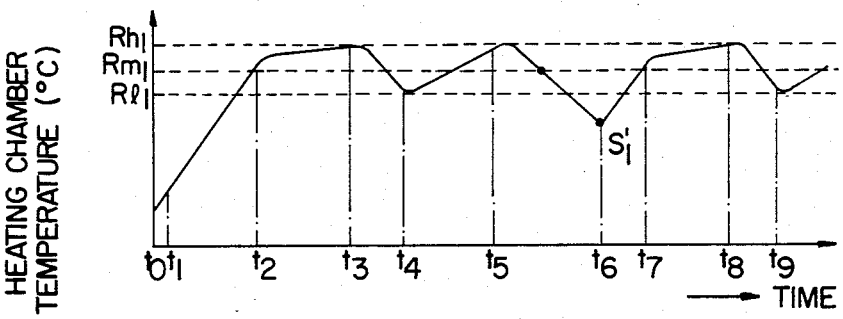

A description will be given of a manner of control in the case of cooking where the preset heating temperature is in the "low" range of about 150°-200° C. As shown in FIGS. 12-14, in a preheating period from the start to time $t_2$, both of the two main burners 2 and 3 are fired, but when the temperature being detected reaches the preset middle temperature $Tm_1$, one main burner 3 stops firing. However, since the combustion capacity of one burner is large as compared with the size of the heating chamber, the remaining one burner 2 in operation is sufficient for the heating chamber temperature to keep on rising until at time $t_3$ it reaches the upper limit temperature $Th_1$. At this point, the main burner 2 is also put out; that is, none of the two main burners 2 and 3 are firing, with the pilot alone firing. As a result, the temperature lowers, and at time $t_4$ the middle temperature $Tm_1$ is reached whereupon one main burner 3 is fired again. Henceforth such an on-off operation is repeated. In this case also, since it is not all main burners but only one main burner 3 that is on-off operated, the temperature change is small.

In the case of cooking in the low temperature region, normally the temperature in the heating chamber is on the increase even after one main burner 3 is turned off, but under special conditions as when the gas pressure is so low that the use of a single burner alone is insufficient or when the ambient temperature is extremely low as in midwinter, if one main burner 3 is turned off, the heating chamber temperature will soon lower to the lower limit temperature $Tl_1$. In this case, therefore, one main burner 3, now put out, is ignited again to keep the temperature rising. This operation is the same as the one that was described with reference to cooking in the high temperature region; thus, even if the setting is in the low temperature region, the control circuit will automatically come into operation depending upon a change in the external conditions including gas pressure and ambient temperature, so as to provide the optimum conditions for maintaining the preset temperature.

Operations similar to the one described above will be performed in the case of cooking in the medium and high temperature regions. In addition, the number of main burners to be used may be optionally determined, as occasion demands.

As is clear from the foregoing description, the present embodiment assigns three levels of detection to the temperature sensor 6 for detecting the upper limit temperature, middle temperature and lower limit temperature, wherein upon detection of the upper limit temperature, all main burners are turned off; upon detection of the middle temperature, the combustion heat generation rate of the main burners is reduced approximately by half; and upon detection of the lower limit temperature, all the main burners are turned off. Thus, the following effects are obtained.

1. Generally, the flow rate varies to a large extent with the types of the gas, nozzle and governor, and in the case of coal gas, the calculated flow rate decreases by about 40 percent at worst, which accounts for the fact that with the conventional heating control system, the combustion heat generation rate is insufficient, leading to a failure in cooking or to protraction of the cooking time. In contrast, in the present embodiment, the microcomputer control automatically compensates the combustion heat generation rate for variations in the input gas flow rate, so that the proper combustion heat generation rate can be maintained for any preset temperature.

2. Since the temperature sensor, providing selective use of three levels of heating power, makes it possible to finely control heating, the size of variations in the heating chamber temperature is small, ensuring satisfactory results of cooking.

3. Since full heating power is developed in the initial stage of heating, the initial rise of temperature is quick. Further, even if the door is opened during heat, the initial re-rise of temperature is also quick because of the development of the full heating power.

4. During heating for initial rise of temperature one of the main burners is put out when the central temperature Tm is reached, so that less overshooting takes place and no preheating is required and hence the cooking time is shortened.

5. Since the frequency of on-off actions of the solenoid valve is reduced, the durability of the solenoid valve is improved and low-noise operation is possible.

6. Complex control in multistage, such as three stages "strong, medium, weak," is made possible by computer control.

As has been described so far, according to the present invention, any preset temperature can be automatically compensated for insufficient gas flow rates dependent on the type of the gas or due to various troubles to the piping, and sufficient gas flow rates can be attained. Further, the main burners are controlled so that they develop their full power, about half the full power or zero power when the temperature being detected by the temperature sensor reaches one of the at least three temperatures, namely, the upper limit temperature, middle temperature and lower limit temperature, no matter what the preset heating temperature may be. Thus, it is possible to provide a cooking appliance causing smaller size of variations in the heating chamber temperature, thus ensuring satisfactory results of cooking.

We claim:

1. A cooking appliance comprising: a heating chamber for receiving a heating load, a heating means for heating said heating chamber, an input means for providing a preset temperature input, a temperature sensor for detecting the temperature in said heating chamber, and a control means including a microcomputer for controlling the heat output and heating time of said heating means in response to signals from said temperature sensor and said input means, wherein temperatures detectible by said temperature sensor are classified by means contained within said microcomputer into at least three levels, namely, an upper limit temperature, a middle temperature, and a lower limit temperature according to said preset heating temperature and wherein said heat output of said heating means is changed in a stepwise fashion according to said temperatures at the respective levels so as to control said heating chamber with respect to said preset heating temperature; and wherein when said temperature being detected by said temperature sensor is respectively said upper limit temperature, said middle temperature and said lower limit temperature, said heating means develops no heat output, half its full heat output and its full heat output, respectively, thereby controlling the atmosphere in said heating chamber so as to be at said preset heating temperature.

2. A cooking appliance as set forth in claim 1, wherein in an initial stage of heating, said heating means develops its full output, but it develops half of its full output when said middle temperature is first reached and henceforth it varies its output with respect to said detected temperature, thereby controlling the atmosphere in the heating chamber so that it is at said preset heating temperature.

* * * * *